US008789813B2

(12) United States Patent
Imbusch et al.

(10) Patent No.: US 8,789,813 B2
(45) Date of Patent: Jul. 29, 2014

(54) LIFTING APPARATUS, ESPECIALLY CABLE TRACTION MECHANISM, COMPRISING CONNECTING POSSIBILITIES

(75) Inventors: Gereon Imbusch, Mettmann (DE); Thomas Kohlenberg, Paderborn (DE); Franz Schulte, Herdecke (DE); Dingyuan Zhao, Chibi (CN); Wenke Sui, Shanghai (CN); Jinping Zhang, Shanghai (CN)

(73) Assignee: Demag Cranes & Components GmbH, Wetter (DE)

( * ) Notice: Subject to any disclaimer, the term of this patent is extended or adjusted under 35 U.S.C. 154(b) by 12 days.

(21) Appl. No.: 13/510,607

(22) PCT Filed: Nov. 15, 2010

(86) PCT No.: PCT/EP2010/067493

§ 371 (c)(1),
(2), (4) Date: Jun. 28, 2012

(87) PCT Pub. No.: WO2011/061152

PCT Pub. Date: May 26, 2011

(65) Prior Publication Data

US 2012/0256145 A1 Oct. 11, 2012

(30) Foreign Application Priority Data

Nov. 21, 2009 (DE) ..... 10 2009 054 225
Nov. 21, 2009 (DE) ..... 10 2009 054 226
Oct. 19, 2010 (DE) ..... 10 2010 048 946

(51) Int. Cl.
*B66D 1/00* (2006.01)

(52) U.S. Cl.
USPC ..... 254/388; 254/329; 254/332

(58) Field of Classification Search
USPC ..... 254/323, 278, 324, 328, 329, 330, 331, 254/332; 248/125.2
See application file for complete search history.

(56) References Cited

U.S. PATENT DOCUMENTS 3,066,917 A * 12/1962 Tuplin et al. ..... 254/278
3,766,795 A * 10/1973 Priest et al. ..... 74/405

(Continued)

FOREIGN PATENT DOCUMENTS

DE 561113 C 10/1932
DE 851250 B 10/1952

(Continued)

OTHER PUBLICATIONS

Translation of the International Preliminary Examination Report on Patentability for corresponding International Application No. PCT/EP2010/067493.

(Continued)

*Primary Examiner* — Emmanuel M Marcelo
*Assistant Examiner* — Michael Gallion
(74) *Attorney, Agent, or Firm* — Gardner, Linn, Burkhart & Flory, LLP

(57) ABSTRACT

A lifting apparatus, especially a cable traction mechanism, comprising a base frame that has at least two base plates, further comprising at least two longitudinal beams that interconnect the base plates and are spaced apart from each other, and at least one attachable cross-member for cable reeving parts that is fastened to the base plates and extends substantially parallel to the longitudinal beams. Multiple mounting points, to which the attachable cross-member for cable reeving parts can be alternatively and detachably fastened, may be arranged on each of the base plates to promote modularity of the lifting apparatus.

21 Claims, 6 Drawing Sheets

(56) References Cited

U.S. PATENT DOCUMENTS

| | | | | |
|---|---|---|---|---|
| 3,994,476 | A * | 11/1976 | van Gennep | 254/272 |
| 4,042,213 | A * | 8/1977 | Schreyer et al. | 254/270 |
| 5,816,564 | A | 10/1998 | Winter | |
| 5,947,450 | A * | 9/1999 | Grapes | 254/329 |
| 6,494,437 | B1 * | 12/2002 | Boyer | 254/323 |
| 6,793,203 | B2 * | 9/2004 | Heinrichs et al. | 254/342 |
| 6,966,544 | B2 * | 11/2005 | McCormick et al. | 254/342 |
| 7,028,989 | B2 * | 4/2006 | Flynn et al. | 254/323 |
| 7,097,157 | B1 * | 8/2006 | Lodrick | 254/362 |
| 7,364,136 | B2 * | 4/2008 | Hossler | 254/278 |
| 7,377,486 | B2 * | 5/2008 | Winter et al. | 254/380 |
| 7,419,137 | B2 * | 9/2008 | Boon | 254/323 |
| 7,469,881 | B2 * | 12/2008 | Alipour et al. | 254/362 |
| 7,766,308 | B2 * | 8/2010 | Kochan et al. | 254/394 |
| 7,850,146 | B2 * | 12/2010 | Kempf | 254/333 |
| 7,909,308 | B2 * | 3/2011 | Lauder et al. | 254/382 |
| 2007/0029533 | A1 * | 2/2007 | Winter et al. | 254/266 |
| 2007/0075174 | A1 * | 4/2007 | Kohlenberg et al. | 242/397.2 |
| 2008/0061277 | A1 * | 3/2008 | Grapes et al. | 254/352 |
| 2008/0083912 | A1 * | 4/2008 | Reznar | 254/323 |
| 2009/0308826 | A1 * | 12/2009 | Kempf | 212/270 |
| 2012/0061634 | A1 * | 3/2012 | Ingelfinger et al. | 254/278 |

FOREIGN PATENT DOCUMENTS

| | | | | |
|---|---|---|---|---|
| DE | 4310770 | A1 | 10/1994 | |
| DE | 19602927 | A1 | 7/1997 | |
| DE | 102005029113 | B3 | 8/2006 | |
| FR | 2928637 | A1 | 9/2009 | |
| JP | 48056761 | U | 7/1973 | |
| WO | WO 2008130402 | A2 * | 10/2008 | B66B 1/76 |

OTHER PUBLICATIONS

International Search Report from corresponding Patent Cooperation Treaty (PCT) Application No. PCT/EP2010/067493.

Written Opinion from corresponding Patent Cooperation Treaty (PCT) Application No. PCT/EP2010/067493.

Transmittal letter dated Sep. 7, 2011 submitting Article 34 Amendments in corresponding PCT/EP2010/067493.

International Preliminary Examination Report from corresponding Patent Cooperation Treaty (PCT) Application No. PCT/EP2010/067493.

* cited by examiner

LIFTING APPARATUS, ESPECIALLY CABLE TRACTION MECHANISM, COMPRISING CONNECTING POSSIBILITIES

RELATED APPLICATION

The present application claims the priority benefits of International Patent Application No. PCT/EP2010/067493, filed on Nov. 15, 2010, and also of German Patent Application Nos. DE 10 2009 054 226.4, filed on Nov. 21, 2009, DE10 2009 054.225.6, filed on Nov. 21, 2009, and DE 10 2010 048 946.8, filed on Oct. 19, 2010, which are all hereby incorporated herein by reference in their entireties.

BACKGROUND OF THE INVENTION

The invention relates to a cable winch having a base frame.

From the German patent DE 10 2005 029 113 B3 a cable winch is known which is driven by an electric motor. The electric motor is flange-mounted on a transmission which is attached laterally and externally to a base frame. The base frame has two base plates disposed in parallel and at a spaced disposition with respect to each other. The base plates are spaced apart from each other via tubular longitudinal beams and are releasably connected to each other. A cable drum is mounted between the base plates and is driven by the electric motor, the rotational axis of which cable drum is orientated in parallel with the longitudinal extension of the longitudinal beams. The components of the lifting apparatus previously designated as base plates can also be housing parts which fulfil different functions of the lifting apparatus. For example, these serve for reception of transmission components, for attachment of the lifting drive, for mounting of the cable drum, for mounting of cross-beams for parts of the cable reeving arrangement, for receiving the electrical equipment, for attachment, including foot-attachment, of the lifting apparatus or for attachment of travelling mechanism parts.

From US 2008/0061277 A1 a marine winch is known. The marine winch has a cable drum which is rotatably mounted between two base plates of a base frame. The base plates are spaced apart from each other and connected to each other via longitudinal beams extending in parallel with the longitudinal direction of the cable drum. Cable guide rollers are provided in order to allow a cable wound on the cable drum to run off from the cable drum or its cable grooves in an ordered manner. The cable guide rollers are, for this purpose, disposed between the base plates and in the region of the circumference of the cable drum. For rotatable mounting of the cable guide rollers, these are each pushed onto a tie rod which serves as a rotational axis, extends in parallel with the longitudinal direction of the cable drum and is attached with both its ends to the inner sides of the base plates.

In US 2009/0308826 A1 a winch for stage use with a cable drum and a comparable base frame consisting of two base plates and longitudinal beams is described. In order to permit uniform winding or unwinding of a cable from the cable drum, a frame-like cable guide device is additionally provided, which is attached to the base plates of the stage winch. The cable running in or out with respect to the cable drum is guided or pretensioned via cable guide rollers which are rotatably mounted on longitudinal beams of the cable guide device disposed between the side walls.

SUMMARY OF THE INVENTION

The object of the invention is to create a lifting apparatus, in particular a cable winch, which is characterised by a modular design.

This object is achieved by a lifting apparatus, in particular a cable winch, in accordance with the present invention.

In accordance with an embodiment of the invention, in the case of a cable winch having a base frame comprising at least two base plates, having at least two longitudinal beams connecting the base plates together and being at a spaced disposition with respect to each other, and having at least one mounting cross-beam for cable reeving parts, which is attached to the base plates and extends substantially in parallel with the longitudinal beams, wherein the cable reeving parts are formed as cable pulleys or cable fixed points which are attached to the mounting cross-beams, a modular design is achieved by virtue of the fact that a plurality of attachment locations are disposed on each of the base plates, on which attachment locations the mounting cross-beam for cable reeving parts can be releasably attached as desired. Therefore, it is easily possible to create a kind of outline on which then, as required, one or two mounting cross-beams for cable reeving parts can be mounted at the respectively required attachment locations. By means of the attachment locations, a universal interface between the base plates and the mounting cross-beams for cable reeving parts is created. In the previously known solutions there is no coherent design for the attachment of the different reeving assemblies such as upper pulleys and cable fixed point cross-beams for the various reeving relationships (such as 2/1; 4/1; 4/2 etc) and the different designs of the lifting apparatus such as lower flange trolley, monorail trolley in a short design type, two-rail trolley and stationary lifting mechanism such as a foot-mounted hoist. Many different assemblies and components are required. This is avoided by the present invention so that the known disadvantages such as high number of parts, cumbersome logistics and administration, high parts costs owing to small batch numbers, inefficient manufacturing and expensive storage have their full impact.

Provision is advantageously made that the base plates are formed in a substantially square or rectangular manner and the attachment locations are disposed on at least two different edges of the base plates. Three attachment locations may be provided per base plate.

In order that the mounting cross-beam for cable reeving parts can also be mounted between the base plates when the cable drum is already mounted or can be shifted to another attachment location, the attachment locations may be disposed outside the regions of the base plates concealed by the cable drum when seen in the direction of the rotational axis of the cable drum. The attachment locations may also be disposed on the inner sides of the base plates.

Space is particularly saved if the attachment locations are formed as first apertures on the first base plate and second apertures on the second base plate. Therefore, the reception plates can be attached to the base plates without the useable length of the cable drum being diminished.

In order easily to permit attachment of the mounting cross-beam for cable reeving parts in a laterally projecting manner with respect to the base plates, the mounting cross-beam for cable reeving parts can be releasably attached to the base plates via first and second reception plates. The first and second reception plates can be placed into the first and second apertures and have an attachment part projecting beyond the contour of the first and second base plates. In this way the suspension bores for the mounting cross-beams of the cable reeving arrangement can easily be produced as bores in simple metal sheets such as the reception plates. These reception plates can easily be mounted in a modular manner as required into the cast parts of the base plates such that the same contact distance of the reception plates is always achieved for a lifting mechanism length. However, when the reception plates are dismounted, the respective sides of the base plates continue to be available for mounting the lifting mechanism to a given connection structure. Furthermore, the overall dimensions of the lifting mechanism with the reception plates dismounted remain advantageously small. The actual functions and dimensions of the lifting gear and of the foot flange are not diminished by the possible mounting of the reception plates. This applies equally for all installation positions of the lifting mechanism and construction types within the series with a fixed length for the lifting mechanism. Considered over the different lengths of the lifting mechanism, the principle of storage and possible mounting of the reception plates remains the same, which means a true modular solution with a simple kit is produced.

In order to be able to follow the vertical orientation of the cable to be wound and unwound, the mounting cross-beam is suspended in an oscillating manner on the respective attachment part of the first and second reception plates.

In a conventional manner, a cable drum is mounted on both ends between and on the inner sides of the base plates, the axis of rotation of the cable drum being orientated in parallel with the longitudinal axis of the longitudinal beams.

An exemplified embodiment of the invention will be explained in more detail hereinafter with reference to the accompanying drawings.

DESCRIPTION OF THE PREFERRED EMBODIMENTS

Figure 1:
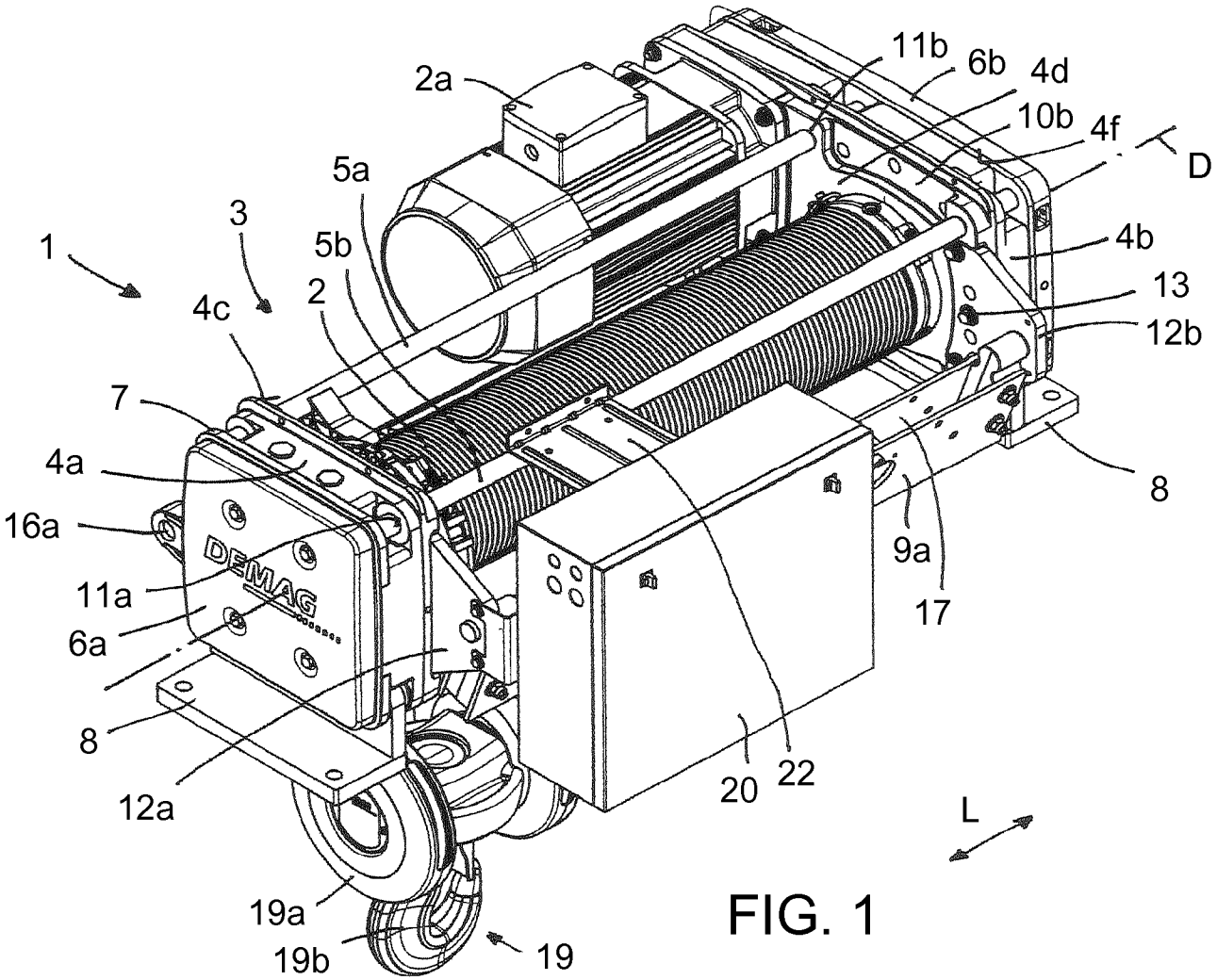
FIG. 1 shows a perspective view of a cable winch in accordance with the invention, formed as a foot-mounted hoist.

FIG. 1 shows a perspective view of a cable winch 1 in accordance with the invention having a cable drum 2 which is mounted at both ends in a base frame 3. The cable winch 1 is formed as a so-called foot-mounted hoist and, with angle elements 8 attached to the base frame 3, is set on a support structure, not shown, or on a warehouse floor and attached at that location.

The base frame 3, which is on the whole shaped like a cuboid, consists on the one hand of a first base plate 4*a* and a second base plate 4*b*, the cable drum 2 being mounted on the mutually facing first and second inner sides 4*c* and 4*d* thereof. The cable drum 2 is rotatable about a rotational axis D and is driven by an electric motor 2*a* via a transmission 2*b*. The first base plate 4*a* and the second base plate 4*b* are each cuboidal or rectangular as seen in cross-section and each formed with rounded corner regions.

On the other hand, the cuboidal base frame 3 consists of several longitudinal beams, up to a maximum of four, of which a first longitudinal beam 5*a* and a second longitudinal beam 5*b* can be seen in FIG. 1. A third longitudinal beam is disposed below the first longitudinal beam 5*a* and is concealed by the cable drum 2. The base plates 4*a*, 4*b* are spaced apart from each other and connected together via the longitudinal beams 5*a*, 5*b*. The longitudinal beams 5*a*, 5*b* are disposed in the corners of an imaginary quadrilateral in the first and second base plates 4*a*, 4*b*. In the case of the first base plate 4*a*, the longitudinal beams 5*a*, 5*b* are disposed in the corner regions of the virtually square base plate 4*b*. The second base plate 4*b* comprises, compared with the first base plate 4*a*, a rectangular shape since this is extended beyond the second longitudinal beam 5*b* for attaching the electric motor 2*a*. In a corresponding manner, the second longitudinal beam 5*b* and a possible fourth longitudinal beam are disposed in the region of the front corner regions of the second base plate 4*b* and the first longitudinal beam 5*a* and the third longitudinal beam are disposed approximately in the region of the centre and of the side edge of the second base plate 4*b*. Furthermore, this second base plate 4*b* receives the transmission 2*b* in the region of its outer side 4*f*, which transmission connects the cable drum 2 to the electric motor 2*a* in a drivable manner. For this purpose the base plate 4*b* is formed in the manner of a pot or trough in the region of its outer side 4*f*.

The longitudinal beams 5*a*, 5*b* are formed as solid bars and two to four longitudinal beams 5*a*, 5*b* are provided depending upon the usage application of the cable winch 1, said beams being disposed in selected corners, or in all corners, of the base plates 4*a*, 4*b*. The longitudinal beams 5*a*, 5*b* are used to connect the base plates 4*a*, 4*b* together so as to be resistant to twisting and the desired distance and the parallelism between the two base plates 4*a*, 4*b* within the desired tolerances are achieved by the length of the longitudinal beams 5*a*, 5*b*. In the illustrated exemplified embodiment, a total of three longitudinal beams 5*a*, 5*b* are provided. A fourth longitudinal beam 5 is not mounted in order not to hinder the winding and unwinding of a cable, not shown, from the cable drum 2. The longitudinal beams 5*a*, 5*b* each comprise a first beam end and an opposite second beam end. The first beam ends are each releasably attached in the first base plate 4*a* and the second beam ends are each releasably attached in the second base plate 4*b*. Screw connections are preferably used for this purpose and first and second reception openings 11*a*, 11*b* for receiving the beam ends of the longitudinal beams 5*a*, 5*b* are disposed in the base plates 4*a*, 4*b*.

FIG. 1 shows the cable winch in a so-called operating state, i.e., after assembly of the longitudinal beams 5*a*, 5*b*. In this operating state the longitudinal beams 5*a*, 5*b* are orientated with their longitudinal axes L in parallel with and laterally offset from the rotational axis D of the cable drum 2.

FIG. 1 shows a cable winch 1 as a so-called foot-mounted hoist. This cable winch 1 can, when using other mounting elements, also become—instead of the illustrated angle elements 8—a component of a crane trolley, in which travelling mechanism components are attached to the base plates 4*a*, 4*b*. Possible crane trolley designs include a lower flange crane trolley, a monorail crane trolley in a short design with the cable winch 1 arranged next to the rail, and a two-rail crane trolley. The number of longitudinal beams 5*a* and 5*b* can vary between two to four and is dependent on the respective stability requirements of the base frame 3 and the installation position of the cable winch 1 and the resulting cable run-out from the cable drum 2. It can be advantageous to dispense with a support rod in the region of the cable run-out.

In a corresponding manner, the base plates 4*a* 4*b* have, in addition to mounting the cable drum 2, various other functions such as for example receiving transmission components, supporting the electric drive 2*a*, receiving mounting cross-beams for parts of a cable reeving arrangement, housing electric equipment, allowing the attachment of feet of the cable winch or attaching travelling mechanism parts.

In order to attach first and second mounting cross-beams 9*a*, 9*b* for parts of a cable reeving arrangement between the two base plates 4*a*, 4*b*, extending in parallel with the cable drum 2 and adjacent the cable drum 2, respective attachment locations are provided on the inner side 4*c* of the first base plate 4*a* and on the inner side 4*d* of the second base plate 4*b*. In each case a plurality of attachment locations are provided, of which one or two are used to selectively attach first and second mounting cross-beams 9*a*, 9*b* to the cable winch 1 as required and according to the use of the cable winch, the orientation of the electric motor 2*a* and the desired position of the run-out of the cable from the cable drum. The attachment locations are formed as first apertures 10*a* let into the inner side 4*c* of the first base plate 4*a*, and second apertures 10*b* let into the inner side 4*d* of the second base plate 4*b*. For each base plate 4*a*, 4*b* three apertures 10*a*, 10*b* are provided which each have an essentially flat and rectangular shape and extend with their longitudinal extension in parallel with the outer edge of the respective base plate 4*a*, 4*b*. The first and second apertures 10*a*, 10*b* are also each disposed outside the corner regions with the first and second reception openings 11*a*, 11*b* for the longitudinal beams 5*a* and 5*b* and therefore between the reception openings 11*a*, 11*b*. A respective first and a second reception plate 12*a*, 12*b* in the desired number are placed into the first and second apertures 10*a*, 10*b* and at the desired attachment locations are placed into a respective first and second aperture 10*a*, 10*b* and then attached to the first and second base plates 4*a*, 4*b* with at least two screws 13 at that location. The reception plates 12*a*, 12*b* can be separated in relation to their function into an attachment region 12*c* and a suspension region 12*d*. In the attachment region 12*c* the releasable attachment of the reception plates 12*a*, 12*b* in the apertures 10*a*, 10*b* takes place and in the suspension region 12*d* the attachment of the mounting cross-beam 9 takes place. Furthermore, the reception plates 12*a*, 12*b* are flat and in the form of sheet metal and have a thickness corresponding to the depth of the aperture 10*a*, 10*b* as seen in the longitudinal direction L and looking towards the respective inner side 4*c*, 4*d* of the base plate 4*a*, 4*b*. The outer contour of the reception plates 12*a*, 12*b* is selected such that these plates fit with their attachment region 12*c* into the apertures 10*a*, 10*b* while maintaining a gap. The apertures 10*a*, 10*b* are open to the outer edge of the base plate 4*a*, 4*b* so that the reception plate 12*a*, 12*b* projects laterally over the base plate 4*a*, 4*b* with its suspension region 12*d*. The reception plates 12*a*, 12*b* as a whole have an almost triangular shape with a flattened peak and a rectangular base in the attachment region 12*c*. In the attachment region 12*c*, three bores 14 are provided through which the screws 13 are passed and are screwed in threaded bores 14 in the inner side 4*c*, 4*d* of the base plate 4*a*, 4*b* in the region of the apertures 10*a*, 10*b*. In order to transfer the forces between the reception plates 12*a*, 12*b* and the base plates 4*a*, 4*b*, alignment pins or bushings are provided in addition to the screws 13 or the screws 13 are formed as fitting screws.

FIG. 1 shows that a first reception plate 12*a* is attached to the first base plate 4*a* in the region of its front edge, so that the suspension region 12*d* thereof projects forwards. In a corresponding manner a second reception plate 12*b* is disposed on the opposite second base plate 4*b*. In the respective suspension regions 12*d*, in the region of the end opposite the attachment region 12*c*, a first or second suspension bore 16*a*, 16*b* is disposed in each case. These suspension bores 16*a*, 16*b* serve for oscillating suspension of the front first mounting cross-beam 9*a* via bolts 9*c* disposed on the opposite ends thereof and projecting laterally. The first and second mounting cross-beams 9*a*, 9*b* are therefore pivotable about a horizontal axis which extends in parallel with the rotational axis D and horizontally. For this purpose the bolts 9*c* are disposed in the upper region of the mounting cross-beams 9*a*, 9*b*.

The mounting cross-beams 9*a*, 9*b* in their own right consist essentially of a thin rectangular frame of sheet metal, which defines an opening 17 orientated in the vertical direction. Elements of a cable drive which serve for attachment and guidance of a reeved cable can be installed in the opening 17 as required. The elements are conventionally formed as an upper pulley in the form of a single groove or multiple groove cable pulley 18*a* or as a cable fixed point 18*b* in the form of a cable wedge attached to the mounting cross-beam 9. The cable fixed point 18*b* serves to attach a cable end to the cable winch 1. The cable pulley 18*a* and the cable fixed point 18*b* are disposed between the walls of the mounting cross-beam 9*a*, 9*b* and are attached or mounted thereon. For this purpose, a plurality of bores are disposed in the mounting cross-beam 9*a*, 9*b* in order to dispose the cable pulley 18*a* and the cable fixed point 18*b* depending on the manner of the selected reeving at the correct position relative to the cable drum 2. A second mounting cross-beam 9*b* concealed by the cable drum 2 in FIG. 1 is provided, is disposed opposite the first mounting cross-beam 9*a* in relation to the cable drum 2 and supports a cable pulley 18*a*.

Furthermore, it is clear from FIG. 1 that the cable winch 1 has a load-receiving means in the form of a lower pulley 19 with two deflecting rollers 19*c* and a hook 19*b*. For the sake of clarity, the cables are not shown.

Furthermore, a housing for electrical equipment 20, in which electrical and electronic components are housed, is attached to the first reception plate 12*a* in the region of the first suspension bore 16*a* for the first mounting cross-beam 9*a*, the housing additionally being supported on the second support bar 5*b*.

The two base plates 4*a*, 4*b* in their own right are produced as cast parts and, so as to save weight, are in the shape of a pot open towards the outside having a first and second hollow space respectively, in which the drive, transmission, electrical or electronic components of the cable winch 1 can be housed. As previously stated, the transmission 2*b* is located in the second hollow space. Depending upon requirements and design, the first and second hollow spaces can be closed with a cover 6*a*, 6*b* or can remain open. The second hollow space in the second base plate 4*b* is closed by a second cover 6*b* which is attached to a second outer side 4*e* of the second base plate 4*b* via a frame-shaped holding element 7. This holding element 7 can also be the edge of the second cover 6*b*. The first hollow space in the first base plate 4*a* is closed by a first cover 6*a* which is directly attached to a first outer side 4*e* of the first base plate 4*a* via a frame-shaped holding element 7. This holding element 7 can also be the edge of the first cover 6*a*.

Figure 2:
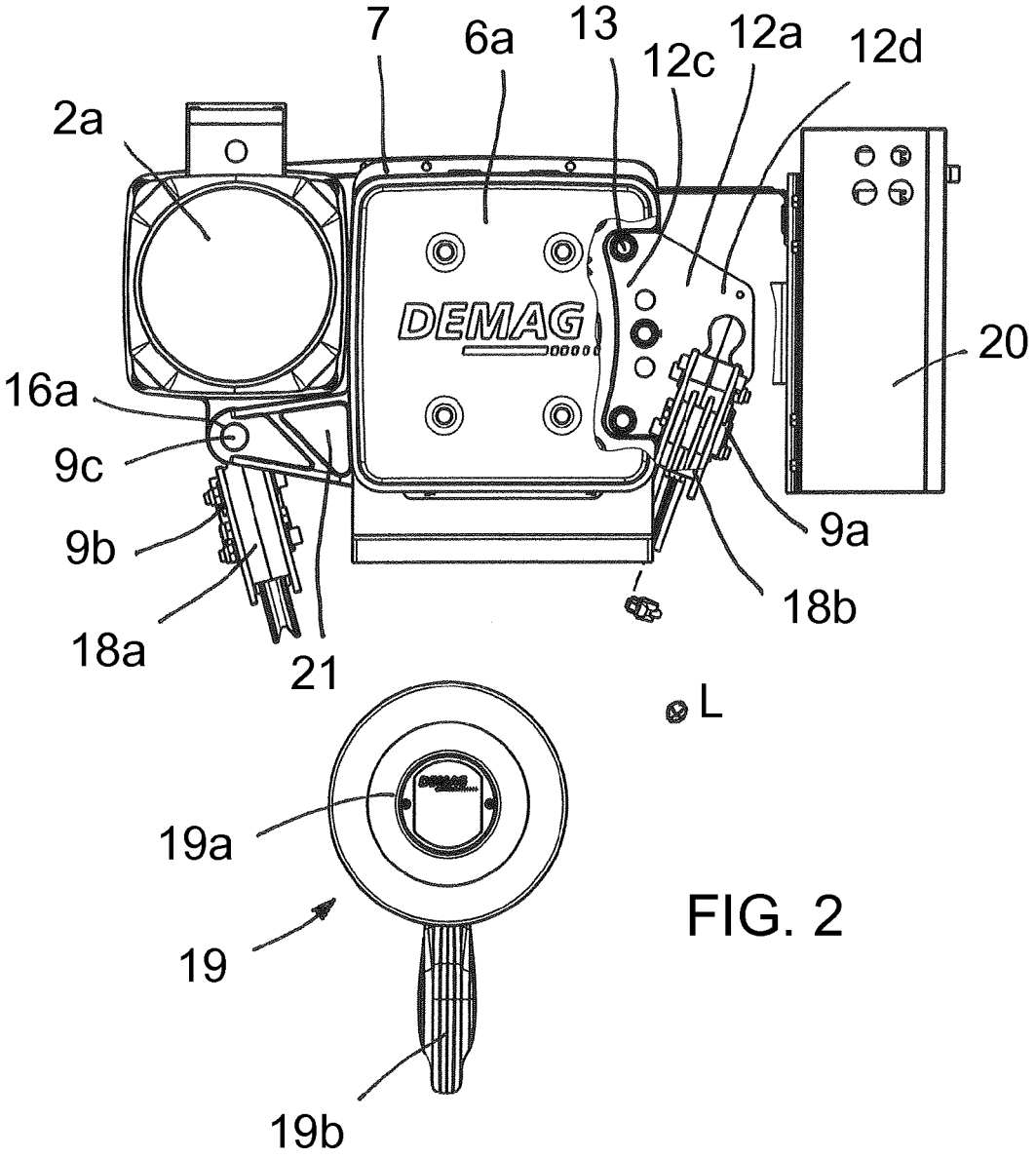
FIG. 2 shows a side view of FIG. 1 partially in vertical section.

FIG. 2 shows a partially cut-away side view of the cable winch 1 of FIG. 1 from the region of the first reception plate 12*a*. The first reception plate 12*a* is screwed to the first base plate 4*a* in its attachment region 12*c* via at least two screws 13 and, in its suspension region 12*d*, supports a bolt 9*c* of the first mounting cross-beam 9*a*. The first mounting cross-beam 9*a* supports a cable fixed point 18*b* and the second mounting cross-beam 9*b* supports a cable pulley 18*a*. The second mounting cross-beam 9*b* is not attached to the first base plate via a reception plate 12*a* but via a reception arm 21 fixedly cast onto the first base plate 4*a* and projecting laterally. Like the reception plates 12*a*, 12*b*, the reception arm 21 has, on its free end, a first suspension bore 16*a* for receiving the bolt 9*c* of the second mounting cross-beam 9*b*. The first reception bore 16*a* in the suspension arm 21 is aligned with an opposing second suspension bore 16*b*—as seen in the longitudinal direction L—in the second base plate 4*b* which, however, is rectangular.

This also applies for the suspension bores 16*a*, 16*b* in the opposing reception plates 12*a*, 12*b*. Since this second base plate 4*b* is rectangular, the second suspension bore 16*b* can be produced directly in the second base plate 4*b* without providing a suspension arm 21.

FIG. 2 also shows that the second, left mounting cross-beam 9*b* is attached to the base plates 4*a*, 4*b* lower than the right, first mounting cross-beam 9*a*. This lower position is based on the fact that the electric motor 2*b* is disposed in the region of the inner side 4*d* of the second base plate 4*b* and therefore the second suspension bore 16*b* had to be displaced further towards the edge and further down in this installation position.

In relation to the first base plates 4*a*, it would be fundamentally possible to provide a modified suspension plate and therefore a fourth aperture instead of the suspension arm 21.

Figure 3:
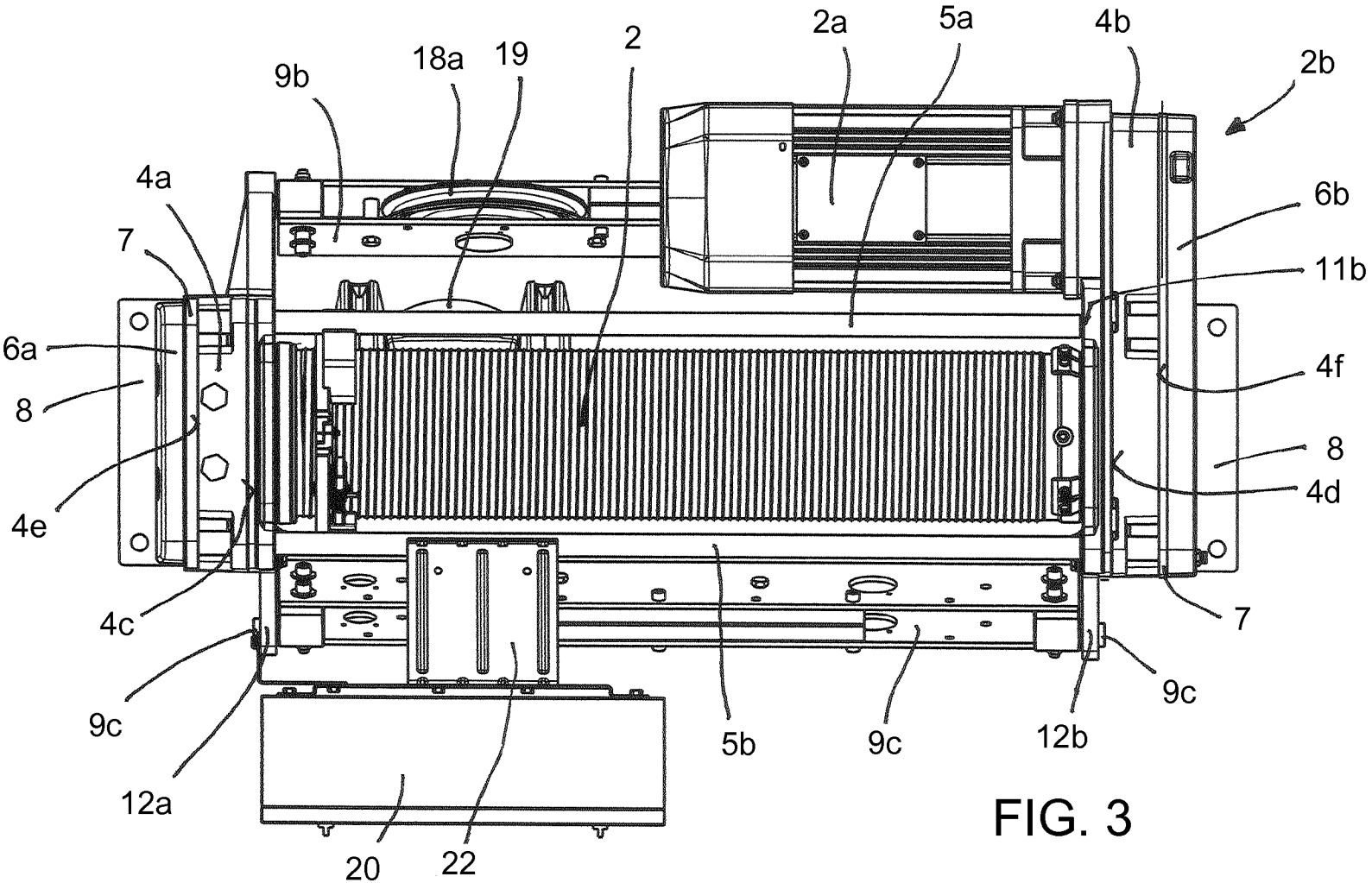
FIG. 3 shows a plan view of FIG. 1.

FIG. 3 shows a plan view of FIG. 1. In addition to the details already described in relation to FIGS. 1 and 2, it is particularly clear that the second mounting cross-beam 9*b* supports the cable pulley 18*a* serving as the upper pulley. The cable fixed point 18*b* is covered by a holder 22 for the electrical equipment housing 20. In relation to the second base plate 4*b* it is also clear to see that the second reception openings 11*b* for the longitudinal beams 5*a*, 5*b*, 5*c* are provided approximately in the middle of the second base plate 4*b* and the electric motor 2*a* is flange-mounted adjacently.

Figure 4:
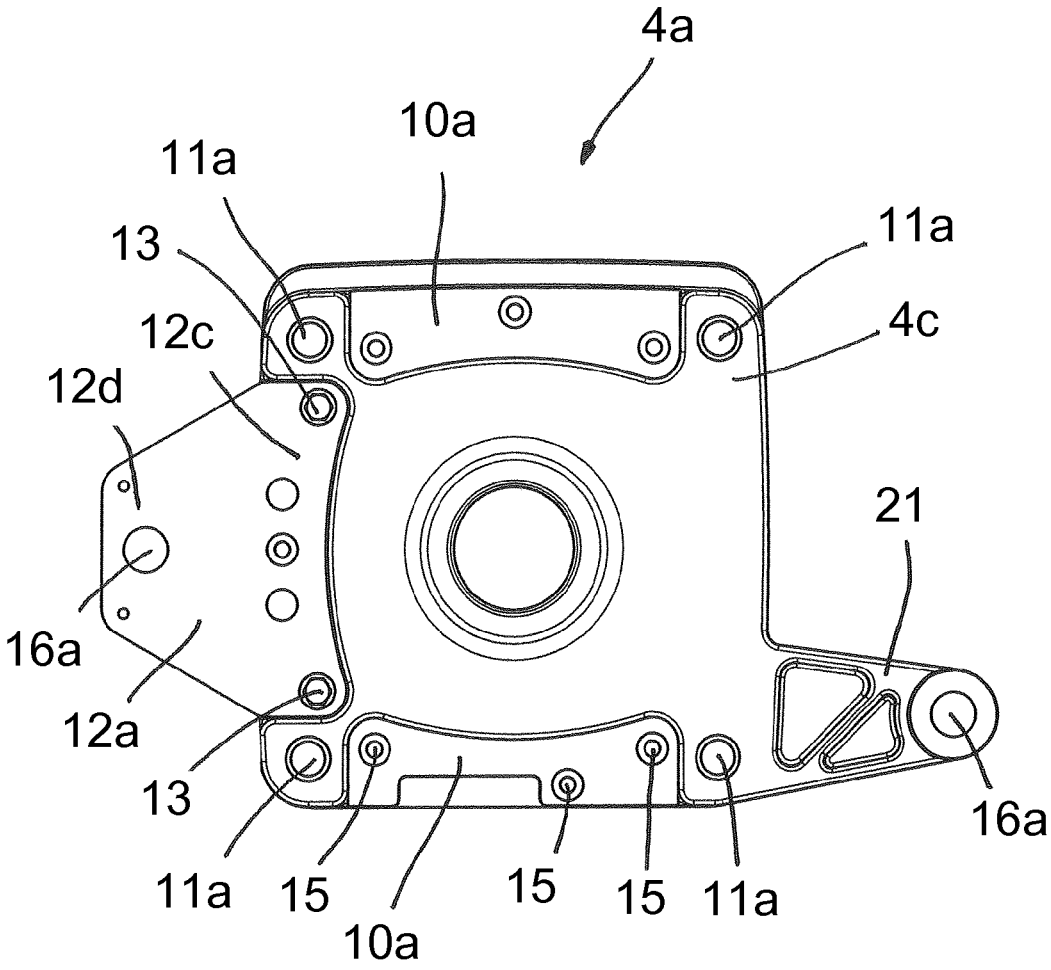
FIG. 4 shows a detailed view of FIG. 1 of an inner side of a first base plate.

FIG. 4 shows a detailed view of the inner side 4*c* of the first base plate 4*a*. It can be seen that the first base plate 4*a* has an almost square cross-section and in the corners the four first reception openings 11*a* for the longitudinal beams 5*a* and 5*b*. Between the reception openings 11*a* in the region of three of the four edges the three first apertures 10*a* are disposed which essentially have a rectangular contour and are open towards the edge. In the region of the side facing the cable drum 2, the apertures 10*a* following the outer contour of the cable drum 2 are tapered in a concave or rounded manner so that the installation and removal thereof can also take place when the cable drum 2 is mounted. The laterally projecting reception arm 21 with the first suspension bore 16*a* can also be seen, this arm being disposed on the edge of the base plate 4*a* which does not have any of the first apertures 10*a*.

Figure 5:
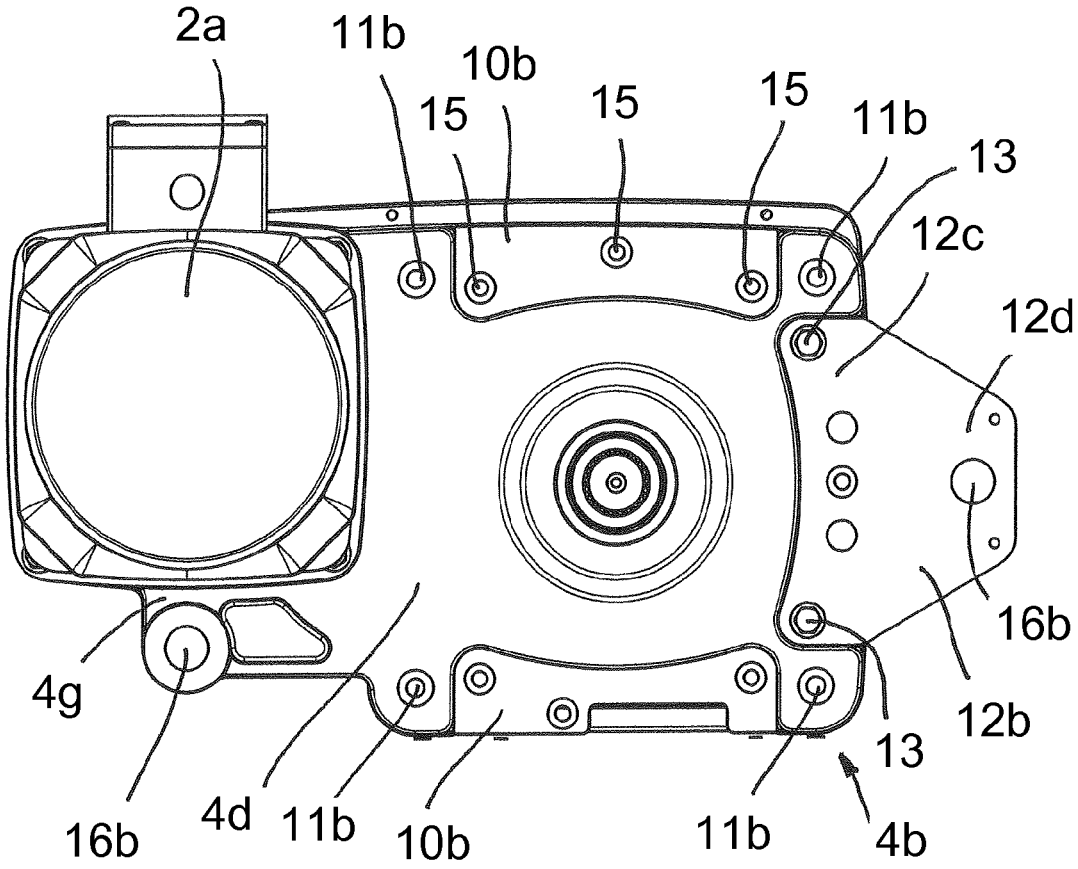
FIG. 5 shows a detailed view of FIG. 1 of an inner side of a second base plate and FIG. 6 shows a perspective view of a cable winch in accordance with the invention as a monorail crane trolley in a lower flange design.

FIG. 5 shows a detailed view of the inner side 4*d* of the second base plate 4*b*. The second base plate 4*b* has an approximately rectangular cross-section and in the corners of an imaginary square the four second reception openings 11*b* for the longitudinal beams 5*a* and 5*b* are disposed. Opposite the first base plate 4*a*, the second base plate 4*b* is extended on one side with a somewhat narrower extended region 4*g*, whereby the rectangular shape is produced. The extended region 4*g* serves for flange mounting of the electric motor 2*a* and reception of one of the second suspension bore 16*b*. Between the reception openings 11*b* in the region of three of the four edges the three second apertures 10*b* are disposed, which have the same contour as the opposing first apertures 10*a*. None of the second apertures 10*b* are disposed in the area of the extended region 4*g*.

Figure 6:
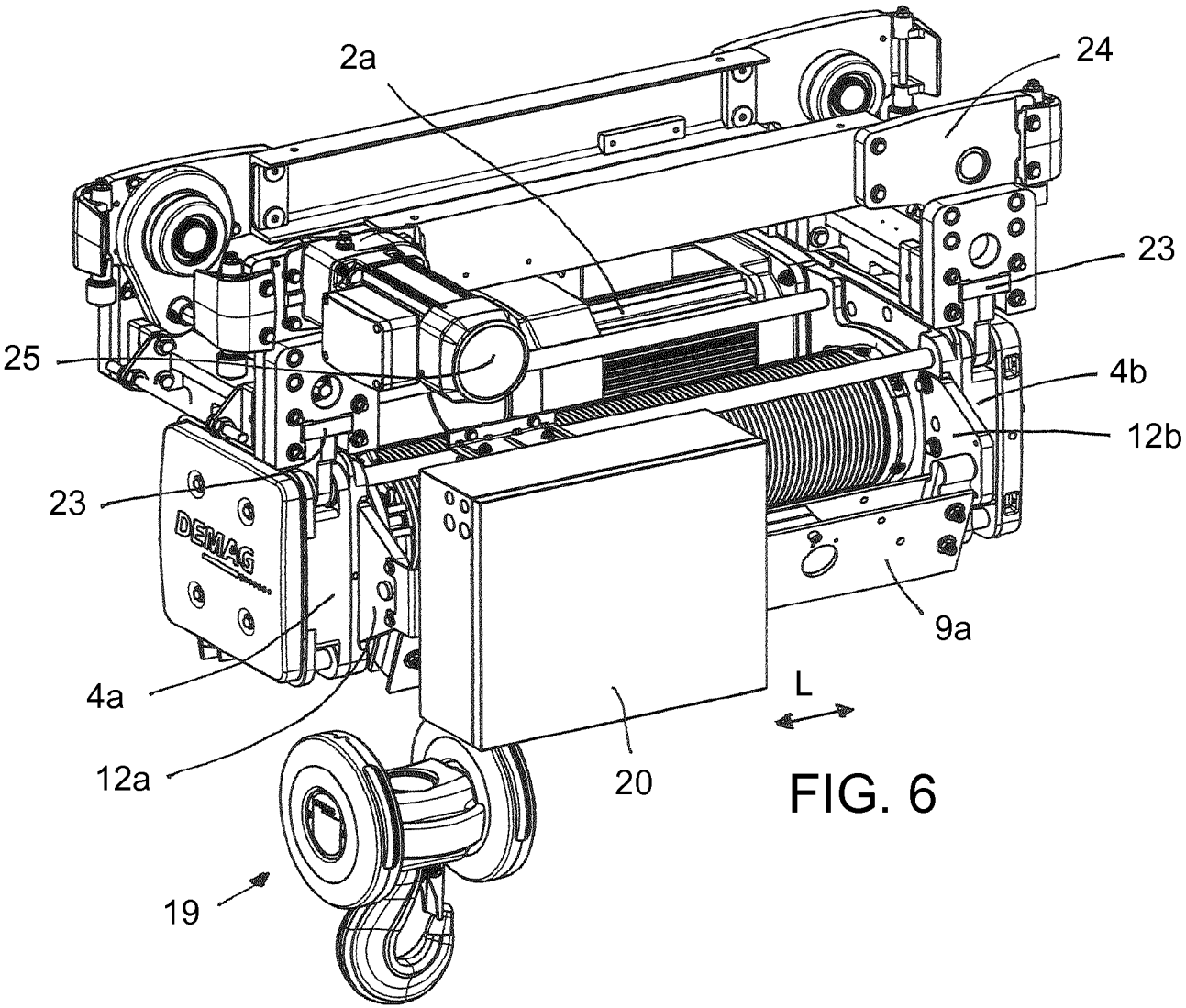

FIG. 6 shows a perspective view of the cable winch 1 in accordance with the invention in an embodiment as a monorail crane trolley in a lower-flange design. Compared with the embodiment as a foot-mounted hoist known from FIG. 1, the mounting elements are not angle elements 8 but holding rails 23 for attaching the cable winch 1 to a travelling mechanism 24 which can travel on a lower flange and has a travel drive 25.

LIST OF REFERENCE NUMERALS

1 Cable winch
2 Cable drum
2*a* Electric motor
2*b* Transmission
3 Base frame
4*a* First base plate
4*b* Second base plate
4*c* Inner side of the first base plate 4*a*
4*d* Inner side of the second base plate 4*b*
4*e* Outer side of the first base plate 4*a*
4*f* Outer side of the second base plate 4*b*
4*g* Extended region
5*a* First longitudinal beam
5*b* Second longitudinal beam
6*a* First cover
6*b* Second cover
7 Holding element
8 Angle elements
9*a* First mounting cross-beam
9*b* Second mounting cross-beam
9*c* Bolt
10*a* First apertures
10*b* Second apertures
11*a* First reception openings
11*b* Second reception openings
12*a* First reception plate
12*b* Second reception plate
12*c* Attachment region
12*d* Suspension region
13 Screws
14 Bores
15 Threaded bores
16*a* First suspension bore
16*b* Second suspension bore
17 Opening
18*a* Cable pulley
18*b* Cable fixed point
19 Lower pulley
19*c* Deflection rollers
19*b* Hook
20 Electrical equipment housing
21 Reception arm
22 Holder
23 Holding rails
24 Travelling mechanism
25 Travel drive
D Rotational axis
L Longitudinal axis

The invention claimed is:

1. Cable winch having a base frame comprising at least two base plates, having at least two longitudinal beams connecting the base plates together and being at a spaced disposition with respect to each other, and at least one mounting cross-beam for cable reeving parts, attached to the base plates and extending essentially in parallel with the longitudinal beams, wherein the cable reeving parts are formed as cable pulleys or cable fixed points which are attached to the mounting cross-beam, wherein a plurality of attachment locations are disposed on each of the base plates, wherein the attachment locations are formed as first apertures on the first base plate and second apertures on the second base plate and at which attachment locations the mounting cross-beam for cable reeving parts can be releasably attached as desired, wherein the mounting cross-beam for cable reeving parts can be releasably attached to the base plates via first and second reception plates, and wherein the first and second reception plates can be placed into the first and second apertures and have an attachment part projecting beyond the contour of the first and second base plates.

2. Cable winch as claimed in claim 1, wherein the base plates are formed in a substantially square or rectangular manner and the attachment locations are disposed on at least two different edges of the base plates.

3. Cable winch as claimed in claim 1, wherein three attachment locations are disposed per base plate.

4. Cable winch as claimed in claim 1, wherein a cable drum is mounted between the base plates and the attachment locations are disposed outside the regions of the base plates concealed by the cable drum when seen in the direction of the rotational axis of the cable drum.

5. Cable winch as claimed in claim 1, wherein the attachment locations are disposed on the inner sides of the base plates.

6. Cable winch as claimed in claim 1, wherein the mounting cross-beam is suspended in an oscillating manner on the respective attachment part of the first and second reception plates.

7. Cable winch as claimed in claim 2, wherein three attachment locations are disposed per base plate.

8. Cable winch as claimed in claim 2, wherein a cable drum is mounted between the base plates and the attachment locations are disposed outside the regions of the base plates concealed by the cable drum when seen in the direction of the rotational axis of the cable drum.

9. Cable winch as claimed in claim 3, wherein a cable drum is mounted between the base plates and the attachment locations are disposed outside the regions of the base plates concealed by the cable drum when seen in the direction of the rotational axis of the cable drum.

10. Cable winch as claimed in claim 7, wherein a cable drum is mounted between the base plates and the attachment locations are disposed outside the regions of the base plates concealed by the cable drum when seen in the direction of the rotational axis of the cable drum.

11. Cable winch as claimed in claim 2, wherein the attachment locations are disposed on the inner sides of the base plates.

12. Cable winch as claimed in claim 3, wherein the attachment locations are disposed on the inner sides of the base plates.

13. Cable winch as claimed in claim 4, wherein the attachment locations are disposed on the inner sides of the base plates.

14. Cable winch as claimed in claim 10, wherein the attachment locations are disposed on the inner sides of the base plates.

15. Cable winch having a base frame comprising at least two base plates, having at least two longitudinal beams connecting the base plates together and being at a spaced disposition with respect to each other, and at least one mounting cross-beam for cable reeving parts, attached to the base plates and extending essentially in parallel with the longitudinal beams, wherein the cable reeving parts are formed as cable pulleys or cable fixed points which are attached to the mounting cross-beam, wherein a plurality of attachment locations are disposed on each of the base plates, wherein the attachment locations are formed as first apertures on the first base plate and second apertures on the second base plate and wherein the apertures are three-dimensional areas recessed into the base plates that form radially facing openings at a perimeter edge of the base plates and at which attachment locations the mounting cross-beam for cable reeving parts can be releasably attached as desired, wherein the mounting cross-beam for cable reeving parts is releasably attached to the base plates via first and second reception plates, and wherein the first and second reception plates are placed into respective ones of the first and second apertures with each reception plate projecting through a respective one of the radially facing openings beyond the perimeter of the first and second base plates.

16. Cable winch as claimed in claim 15, wherein the base plates are formed in a substantially square or rectangular manner and the attachment locations are disposed on at least two different edges of the base plates.

17. Cable winch as claimed in claim 15, wherein three attachment locations are disposed per base plate.

18. Cable winch as claimed in claim 15, wherein a cable drum is mounted between the base plates and the attachment locations are disposed outside the regions of the base plates concealed by the cable drum when seen in the direction of the rotational axis of the cable drum.

19. Cable winch as claimed in claim 15, wherein the attachment locations are disposed on the inner sides of the base plates.

20. Cable winch as claimed in claim 15, wherein the base plates are formed in a substantially square or rectangular manner and the radially facing openings are disposed on at least two different edges of the base plates.

21. Cable winch as claimed in claim 20, wherein the attachment locations are disposed on the inner sides of the base plates.

* * * * *